US006979282B1

(12) United States Patent
Mangano

(10) Patent No.: US 6,979,282 B1
(45) Date of Patent: Dec. 27, 2005

(54) PORTABLE FOOT OPERATED EXERCISE DEVICE

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 0 days.

(21) Appl. No.: 11/009,601

(22) Filed: Dec. 10, 2004

(51) Int. Cl.[7] ..... A63B 22/00
(52) U.S. Cl. ..... 482/51; 482/121
(58) Field of Search ..... 482/51, 71, 79, 482/80, 114, 115, 121–124, 146–148; 472/135, 472/136

(56) References Cited

U.S. PATENT DOCUMENTS

| | | | | |
|---|---|---|---|---|
| 2,224,103 | A * | 12/1940 | Nilson | 482/124 |
| 2,256,001 | A | 9/1941 | Titus | |
| 2,950,120 | A | 8/1960 | Stewart | |
| 3,108,802 | A | 10/1963 | Sundquist | |
| 3,438,626 | A | 4/1969 | Modla | |
| 3,512,774 | A | 5/1970 | Honer | |
| 3,612,520 | A | 10/1971 | Chang | |
| 3,640,526 | A * | 2/1972 | Olorenshaw | 482/126 |
| 4,132,404 | A * | 1/1979 | Wilson | 482/132 |
| 4,285,516 | A | 8/1981 | Heatwole | |
| 4,601,469 | A | 7/1986 | Sasser, Jr. | |
| 4,687,198 | A | 8/1987 | Smith | |
| 5,322,493 | A * | 6/1994 | Venner | 482/131 |
| 5,547,447 | A | 8/1996 | Liang | |
| 5,795,277 | A | 8/1998 | Bruntmyer | |
| 6,017,297 | A | 1/2000 | Collins | |
| 6,413,197 | B2 | 7/2002 | McKechnie et al. | |

* cited by examiner

*Primary Examiner*—Stephen R. Crow
*Assistant Examiner*—Tam Nguyen
(74) *Attorney, Agent, or Firm*—Galgano & Burke, LLP

(57) ABSTRACT

A portable foot operated exercise device includes a somewhat elastic fabric base having spaced apart foot sleeves on an upper surface thereof and removable sliding pads on the lower surface thereof. According to the presently preferred embodiment, the base is made of NEOPRENE™, and two pairs of sliding pads are provided. One pair is made of hard plastic and the other pair is made of fleece or a fleece-like material. The pads are preferably provided with a VELCRO® backing and the base is preferably provided with mating VELCRO® on the lower surface beneath the foot sleeves.

14 Claims, 4 Drawing Sheets

PORTABLE FOOT OPERATED EXERCISE DEVICE

BACKGROUND OF THE INVENTION

1. Field of the Invention

The invention relates to exercise equipment. More particularly, the invention relates to a portable foot operated exercise device.

2. Brief Description of the Prior Art

The concept of a portable foot operated exercise device is old in the art. As early as 1940, R. L. Titus described such an "exerciser" in U.S. Pat. No. 2,256,001. The Titus device includes a top disk and a bottom disk which are rotatable relative to each other. The user steps onto the top disk and causes it to rotate by moving his/her legs and or torso. A similar, though slightly more sophisticated device was described by Honer in U.S. Pat. No. 3,512,774 in 1970. A similar, though even more sophisticated device was described in 1987 by Smith in U.S. Pat. No. 4,687,198. The Titus concept was carried further by McKechnie et al. in U.S. Pat. No. 6,413,197 (2002) which describes a device having upper and lower members coupled to each other by a centrally located torsion spring. The user stands on the upper member and causes it to swivel relative to the lower member. Unlike Titus and those who followed, the upper and lower members are not circular and the centrally located torsion spring provides potentially more resistance than the earlier devices.

In 1958, H. L. Stewart described a completely different portable foot operated exercise device in U.S. Pat. No. 2,950,120. Stewart's "locomotion device" is a simple curved board which is placed convex side down on the floor. The user steps onto the board with feet spread apart. By rocking back and forth and swiveling, the board can be made to travel across the floor, unlike the Titus style devices which remain stationary. In the 1960s, Sundquist and Modlar carried the Stewart concept further with more complex devices as described in U.S. Pat. Nos. 3,108,802 and 3,438,626, respectively. Still, in 1981, Heatwole described a device similar to those of Sundquist and Modlar which requires that the user cause opposite sides of the device to be lifted off the floor in order to zig-zag the device forward across the floor. See, U.S. Pat. No. 4,285,516. In 1996, Liang described a device similar to that of Heatwole in U.S. Pat. No. 5,547,447. In 1998, Bruntmyer described a "tilt walker sport board" in U.S. Pat. No. 5,795,277 which is similar in concept to Liang and the predecessors but which has a spring biased suspension and a centrally located rope which the user can grasp to aid in balance.

In 1971, Quong Y. Chang described a "rockable exercise platform for skiers" which is a bowl shaped device with a tread pad on top and an adjustable weight inside. The user stands on the tread pad and, by tilting and swiveling, can simulate forces encountered during skiing.

While all of the above-described devices are relatively simple in construction as compared to many of the more complex modern exercise devices, there is a need for a much simpler exercise device. Moreover, while all of the above-described devices are portable as compared to the relatively immovable exercise devices like large treadmills and elliptical walkers, etc., they are either too heavy, too bulky or both to be carried while traveling. In addition, the above-described devices may not function properly on a carpeted floor or on a highly polished floor.

SUMMARY OF THE INVENTION

It is therefore an object of the invention to provide a portable foot operated exercise device.

It is also an object of the invention to provide a portable foot operated exercise device which consists of a minimal number of parts.

It is another object of the invention to provide a portable foot operated exercise device which is simple and inexpensive to manufacture.

It is still another object of the invention to provide a portable foot operated exercise device which is small enough and light enough to be carried while traveling.

It is yet another object of the invention to provide a portable foot operated exercise device which is adaptable for use on different floor surfaces.

In accord with these objects which will be discussed in detail below, the portable foot operated exercise device according to the invention includes a somewhat elastic fabric base having spaced apart foot sleeves on an upper surface thereof and removable sliding pads on the lower surface thereof. According to the presently preferred embodiment, the base is made of NEOPRENE™, and two pairs of sliding pads are provided. One pair is made of hard plastic and the other pair is made of fleece or a fleece-like material. The pads are preferably provided with a VELCRO backing and the base is preferably provided with mating VELCRO on the lower surface beneath the foot sleeves. Before using the device, the appropriate pads are selected and attached to the underside of the base. The plastic pads are attached when the device is to be used on a carpeted floor and the fleece pads are attached when the device is to be used on a polished or smooth floor surface.

After the proper pads are firmly attached, the user slips one foot at a time into the foot sleeves. With knees slightly bent, the user then takes short swivel steps keeping legs spread apart thereby creating resistance. The size of the steps and the amount of resistance are controlled by the user to meet whatever level of exercise is preferred. The basic exercise is to swivel in a forward motion across the floor, changing direction at will. For a more vigorous exercise, shorter quicker swivel motions with legs as far apart as possible maximizes resistance and engages additional muscle groups. The exercise device can also be used for aerobic exercise if the user raises arms above the heart. Cool down is achieved by lowering the arms and taking longer and slower swivels.

Certain of the foregoing and related objects are also achieved according to the invention by a portable foot operated exercise device, comprising a fabric base having an upper side and a lower side; two spaced apart foot sleeves located on said upper side; and two sliding pads removably coupled to said lower side. Preferably the fabric base is made of an elastic material such as NEOPRENE™.

Most advantageously, the lower side includes a plurality of VELCRO® strips, and the sliding pads each have a plurality of VELCRO® strips arranged to mate with the VELCRO® strips on the lower side. Most desirably, the sliding pads are one of hard plastic and fleece.

In a preferred embodiment, the portable foot operated exercise device kit is provided which comprises a fabric base having an upper side and a lower side; two spaced apart foot sleeves located on said upper side; and two pair of sliding pads, each pair removably attachable to said lower side, one pair being made of a relatively hard material, the other pair being made of a relatively soft material. Here too, the fabric base is made of an elastic material such as NEOPRENE™.

Most advantageously, the base of the kit has a lower side which includes a plurality of VELCRO® strips, and said sliding pads each have a plurality of VELCRO® strips arranged to mate with the VELCRO® strips on said lower side. Most desirably the kit has sliding pads made of hard plastic and the other pair are fleece.

In a particularly preferred embodiment, a portable foot operated exercise device, comprises a generally planar base mat having an upper side and a lower side; two spaced apart foot sleeves located on said upper side; and two sliding pads positioned generally beneath said foot sleeves, said base mat having a stretchable elastic web of material disposed between said spaced-apart foot sleeves which afford resistance to stretching. Once again, the elastic web of material is preferably NEOPRENE™.

In this embodiment, the sliding pads are also advantageously releasably coupled to said lower side of said mat. Most desirably, this is accomplished by providing the lower side with at least two spaced apart strips of mechanically interlocking fasteners and providing said sliding pads with at least one strip of mechanically interlocking fasteners arranged to releasably mate with an opposite one of said strips on lower side. The sliding pads are again preferably selected from the group consisting of hard plastic fleece.

DETAILED DESCRIPTION

Figure 3:
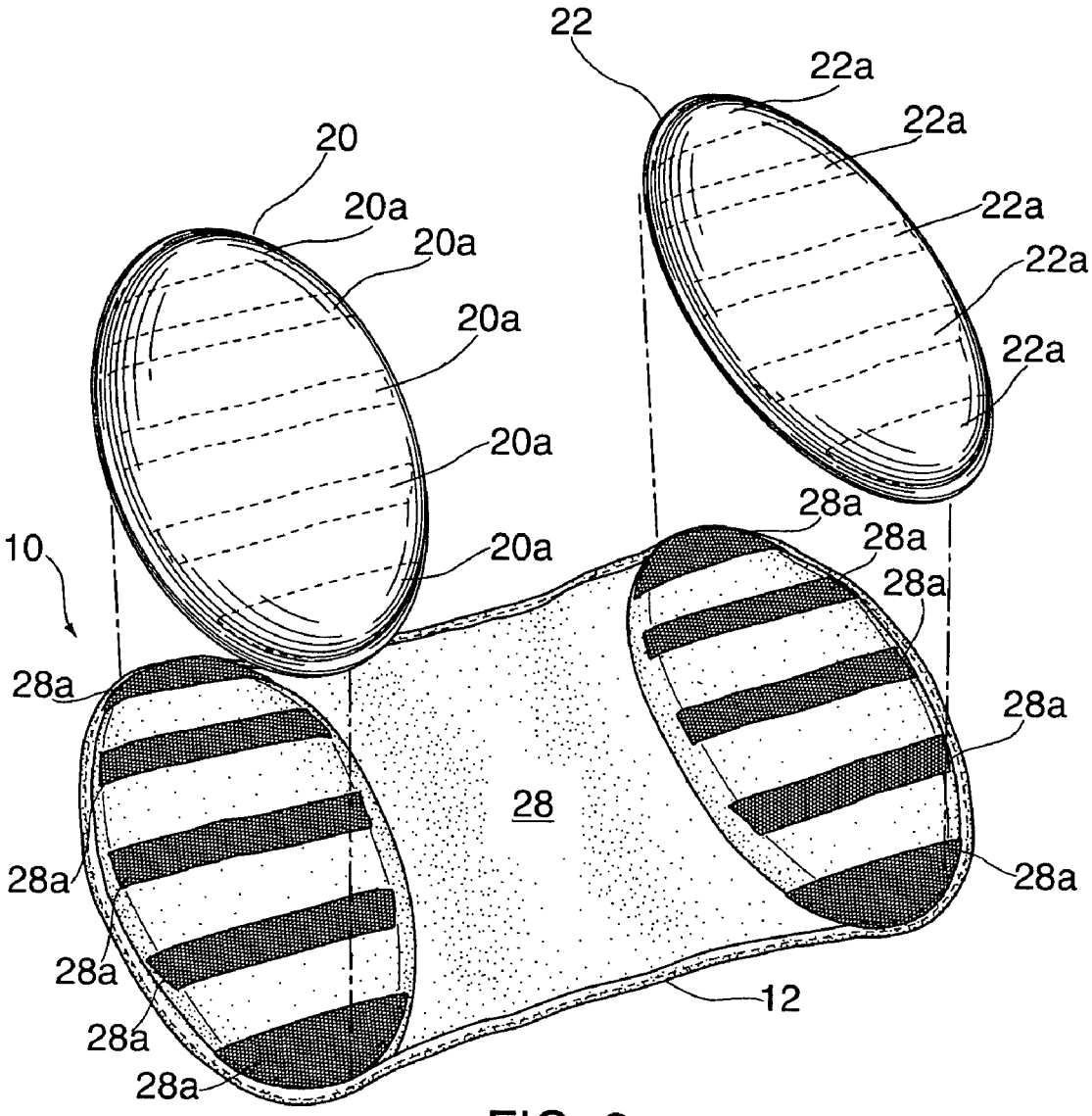
FIG. 3 is an exploded bottom perspective view of the exercise device with the hard plastic sliding pads.
Figure 4:
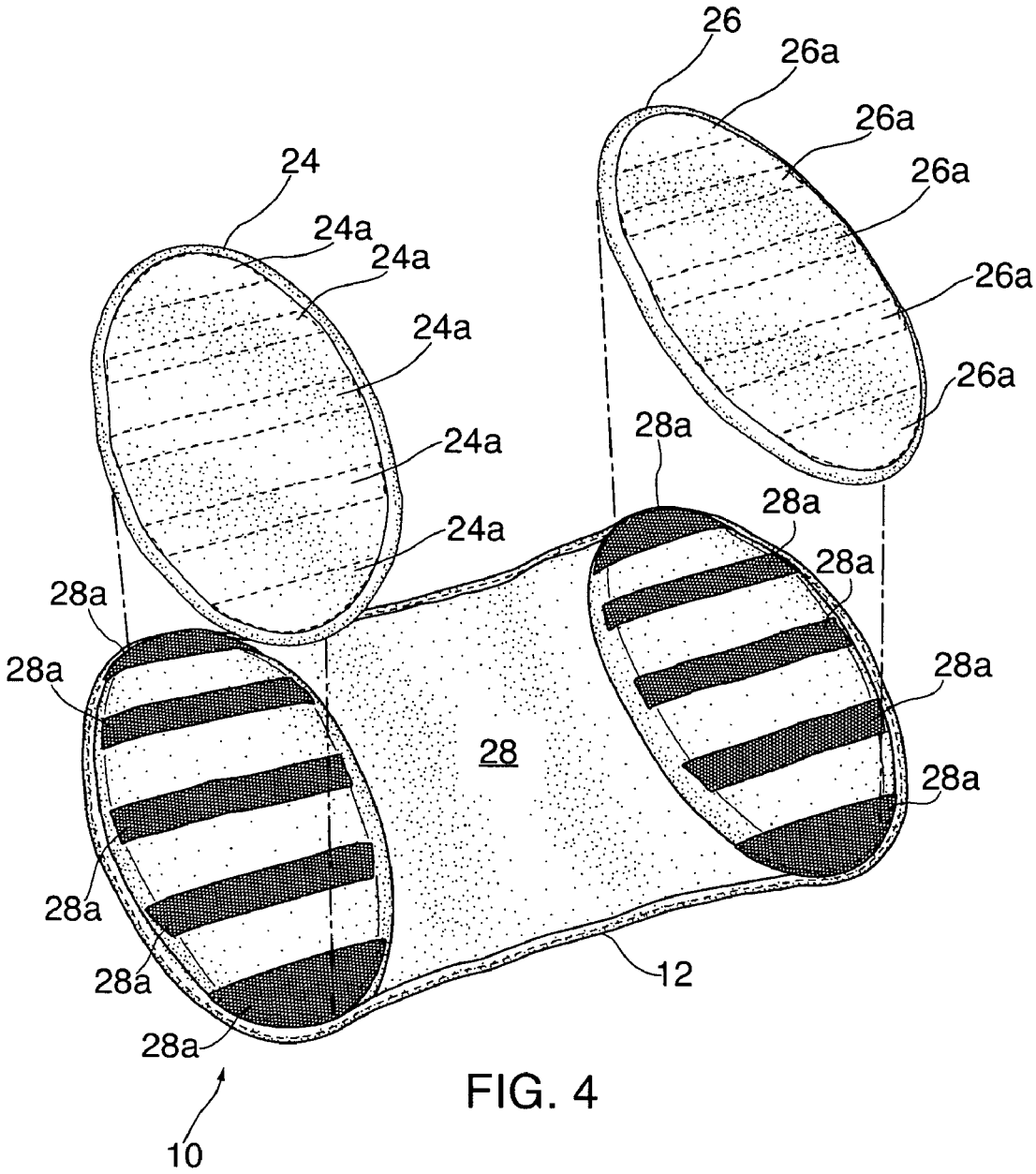
FIG. 4 is an exploded bottom perspective view of the exercise device with the fleece sliding pads.

Turning now to the Figures, generally, the portable foot operated exercise device 10 according to the invention includes a somewhat elastic or stretchable base or base mat 12 preferably made of fabric having spaced apart foot sleeves 14, 16 on an upper surface 18 thereof and a pair of preferably removable sliding pads 20, 22, or 24, 26 on the lower surface 28 thereof. According to the presently preferred embodiment, the base 12 is made of NEOPRENE™, and two pairs of sliding pads 20, 22, and 24, 26 are provided. One pair 20, 22 is made of hard plastic material (FIG. 3) and the other pair 24, 26 is made of fleece or a fleece-like material (FIG. 4). The pads 20, 22, 24, 26 are preferably provided with sewn-on, spaced-apart strips of VELCRO® hook or loop mechanical fasteners 20*a*, 22*a*, 24*a*, 26*a* and the base 12 is preferably provided with mating sewn-on, spaced-apart strips of VELCRO® fasteners 28*a* on the lower surface 28 beneath the foot sleeves 14, 16.

Before using the device 10, the appropriate pads 20, 22 or 24, 26 are selected and attached to the underside 28 of the base 12. The hard plastic pads 20, 22 are attached when the device 10 is to be used on a carpeted floor and the fleece pads 24, 26 are attached when the device 10 is to be used on a polished or smooth floor surface so as to permit the user to move or slide across the room while exercising as discussed below.

Figure 1:
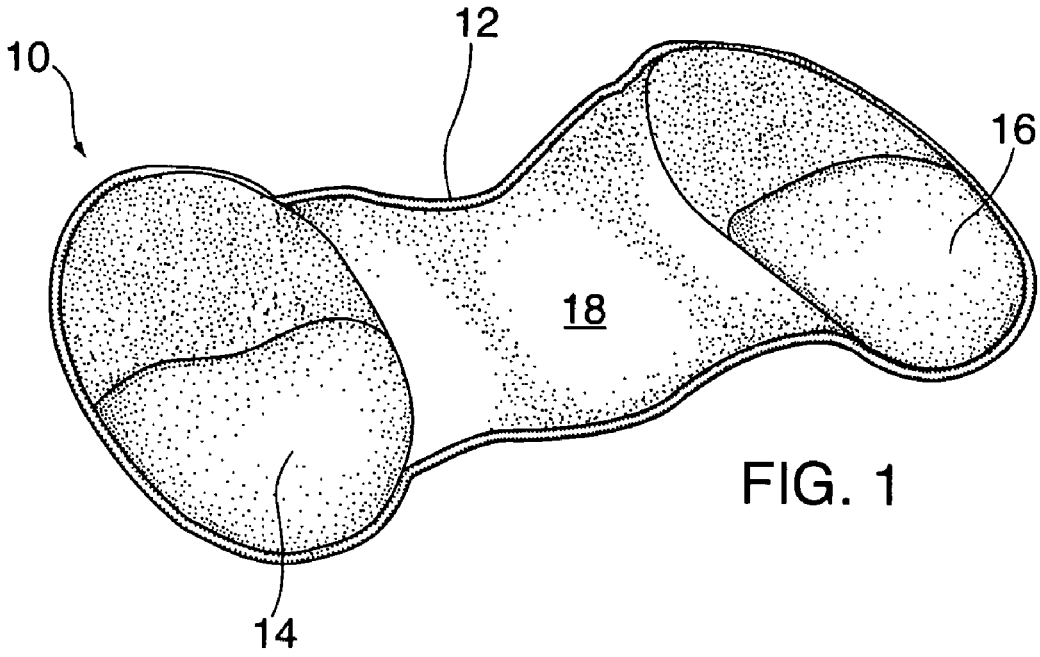
FIG. 1 is a top perspective view of the exercise device.
Figure 2:
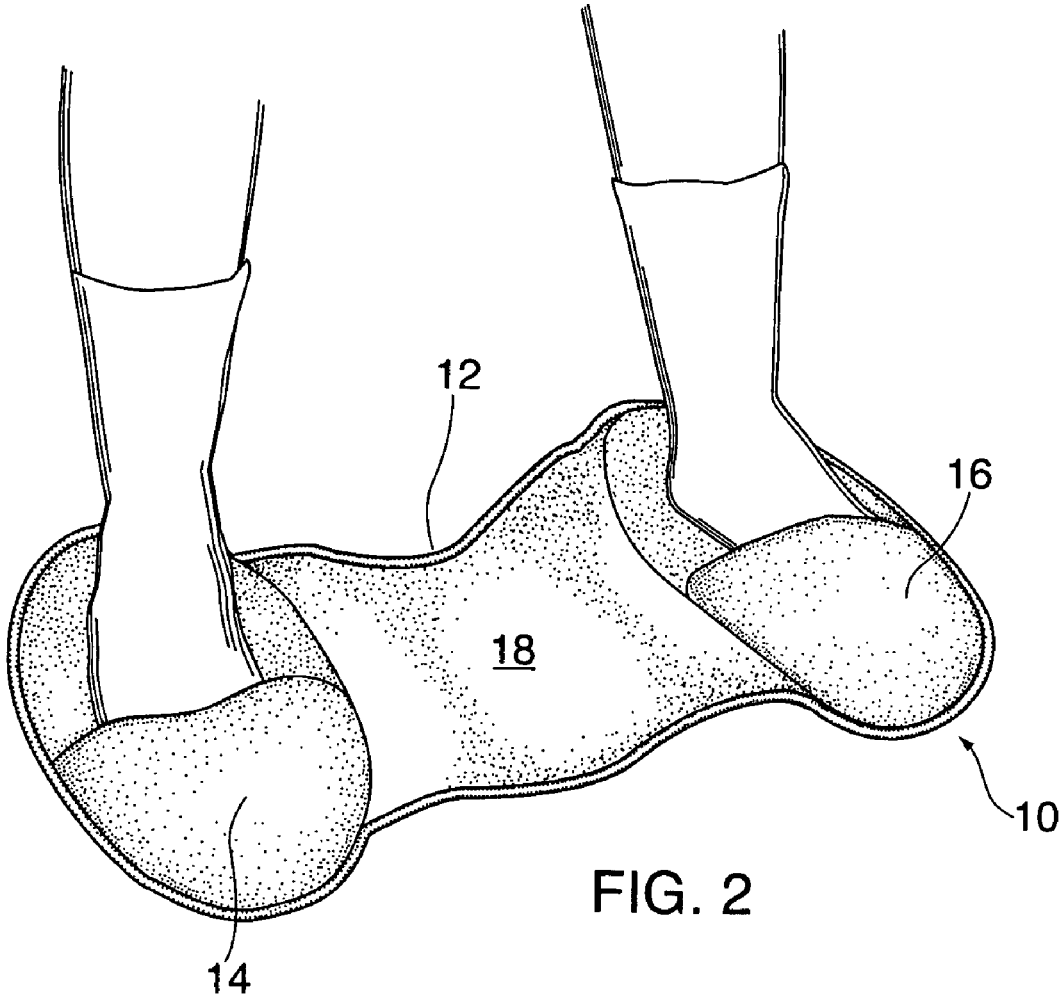
FIG. 2 is a view similar to FIG. 1 showing a user's feet in the foot sleeves.
Figure 5:
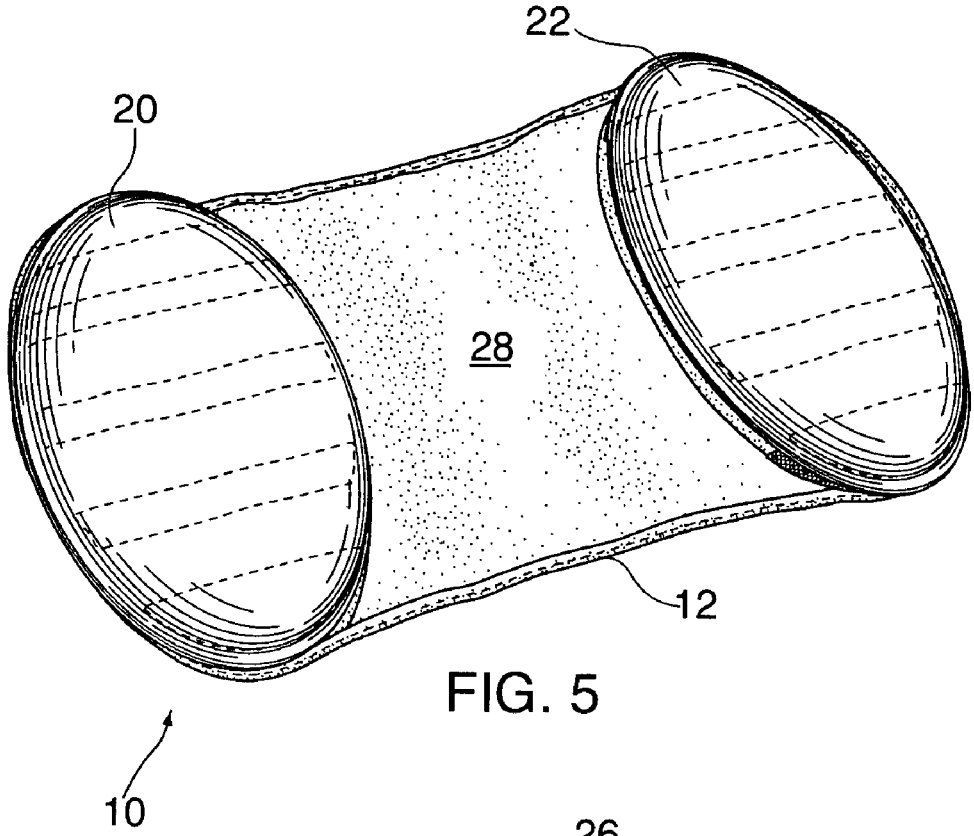
FIG. 5 is an assembled bottom perspective view of the exercise device with the hard plastic sliding pads.
Figure 6:
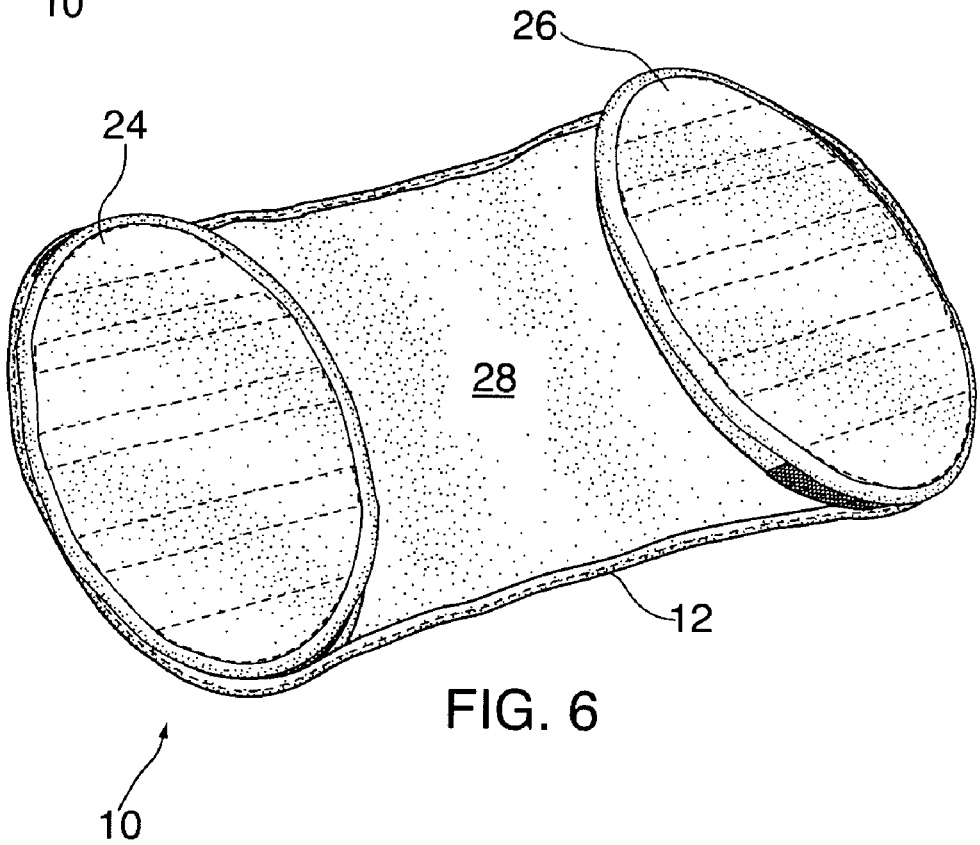
FIG. 6 is an assembled bottom perspective view of the exercise device with the fleece sliding pads.

After the proper pads are firmly attached as shown in FIGS. 5 and 6, the user slips one foot at a time into the foot sleeves 14, 16 as shown in FIG. 2. With knees slightly bent, the user then takes short swivel steps keeping legs spread apart thereby creating resistance via the stretching of the interconnecting web of elastic material 28. The size of the steps and the amount of resistance are controlled by the user to meet whatever level of exercise is preferred (i.e., the larger the steps, the greater stretching and resistance).

The basic exercise is to swivel in a forward motion across the floor, changing direction at will. For a more vigorous exercise, shorter quicker swivel motions with legs as far apart as possible maximizes resistance and engages additional muscle groups. The exercise device can also be used for aerobic exercise if the user raises arms above the heart. Cool down is achieved by lowering the arms and taking longer and slower swivels.

There have been described and illustrated herein a portable foot operated exercise device and methods for its use. While particular embodiments of the invention have been described, it is not intended that the invention be limited thereto, as it is intended that the invention be as broad in scope as the art will allow and that the specification be read likewise.

For example, although the base is preferably entirely made of Neoprine™, other stretchable or elastic materials could be employed which would also permit stretching under resistance to facilitate the exercises being performed. Moreover, certain benefits of the invention may be achieved where only the web portion of the base interconnecting the foot sleeves is made of an in elastic material. In addition, while the pads are preferably releasably coupled to the base via VELCRO® hook and loop fasteners, other types of such fasteners could be used and other releasable attachment means (e.g., magnetic, mechanical interlocks such as zippers, etc.) may be suitable for certain applications.

Moreover, while it is preferable to use removable sliding pads to permit the same base to be used on either hard or carpet covered floors, two separate base mats could be provided—one with permanently affixed hard plastic sliding pads for use on carpeted floors and one with permanently affixed fabric sliding pads for use on hard wood or tiled floors. In addition, although the sliding pads are preferably permanently or removably coupled to the lower side of the mat, they could be incorporated into the lower surface of the mat or their function could possibly be provided by appropriate selection of the mat material itself located on the lower surface of the mat generally beneath the foot sleeves. Furthermore, while the sliding pads are preferably made from hard plastic or fleece, other materials made of other hard materials or fabric, synthetic fabric or like materials may be used.

It will therefore be appreciated by those skilled in the art that yet other modifications could be made to the provided invention without deviating from its spirit and scope as so claimed.

What is claimed is:

1. A portable foot operated exercise device, comprising:

a fabric base having an upper side and a lower side;

two spaced apart foot sleeves located on said upper; and two sliding pads removably coupled to said lower side;

wherein said fabric base is made of an elastic material, said lower side includes a plurality of VELCRO® strips, and said sliding pads each have a plurality of VELCRO® strips arranged to mate with the VELCRO® strips on said lower side.

2. The device according to claim 1, wherein:
said elastic material is NEOPRENE™.

3. The device according to claim 1, wherein:
said sliding pads are one of hard plastic and fleece.

4. The device according to claim 3, wherein:
said sliding pads are hard plastic.

5. The device according to claim 3, wherein:
said sliding pads are fleece.

6. A portable foot operated exercise kit, comprising:
a fabric base having an upper side and a lower side;
two spaced apart foot sleeves located on said upper side; and
two pairs of sliding pads, each pair removably attachable to said lower side, one pair being made of a relatively hard material, the other pair being made of a relatively soft material; wherein said fabric base is made of an elastic material, said lower side includes a plurality of VELCRO® strips, and said sliding pads each have a plurality of VELCRO® strips arranged to mate with the VELCRO® strips on said lower side.

7. The kit according to claim 6, wherein:
said elastic material is NEOPRENE™.

8. The kit according to claim 6, wherein:
one pair of said sliding pads are hard plastic and the other pair are fleece.

9. A portable foot operated exercise device, comprising:
a generally planar base mat having an upper side and a lower side;
two spaced apart foot sleeves located on said upper side; and
two sliding pads positioned generally beneath said foot sleeves, said base mat having a stretchable elastic web of stretching; wherein said sliding pads are releasably coupled to said lower side of said mat disposed between said spaced-apart foot sleeves which afford resistance to stretching.

10. The device according to claim 9, wherein:
said elastic web of material is NEOPRENE™.

11. The device according to claim 10 wherein:
said lower side includes at least two spaced apart strips of mechanically interlocking fasteners; and
said sliding pads each have at least one strip of mechanically interlocking fasteners arranged to releasably mate with an opposite one of said strips on said lower side.

12. The device according to claim 11 wherein:
said sliding pads are selected from a group consisting of hard plastic and fleece.

13. The device according to claim 12, wherein:
said sliding pads are hard plastic.

14. The device according to claim 12, wherein:
said sliding pads are fleece.

* * * * *